US006371399B1

(12) United States Patent
Marchante

(10) Patent No.: US 6,371,399 B1
(45) Date of Patent: Apr. 16, 2002

(54) MACHINE FOR WINDING CONTINUOUS SHEET PRODUCT FOR FORMING COILS

(75) Inventor: Innocent Marchante, Le Bourget Du Lac (FR)

(73) Assignee: Darlet Marchante Technologie, S.A., Le Bourget Du Lac (FR)

( * ) Notice: Subject to any disclaimer, the term of this patent is extended or adjusted under 35 U.S.C. 154(b) by 0 days.

(21) Appl. No.: 09/530,513

(22) PCT Filed: Nov. 5, 1998

(86) PCT No.: PCT/FR98/02373

§ 371 Date: Jun. 27, 2000

§ 102(e) Date: Jun. 27, 2000

(87) PCT Pub. No.: WO99/24342

PCT Pub. Date: May 20, 1999

(30) Foreign Application Priority Data

Nov. 6, 1997 (FR) ..... 97 14188

(51) Int. Cl.[7] ..... B65H 35/00

(52) U.S. Cl. ..... 242/524.1; 242/525; 242/527.3; 242/532.3; 242/533.4

(58) Field of Search ..... 242/533, 533.4, 242/533.5, 533.6, 533.8, 539, 547, 524.1, 525, 527.3

(56) References Cited

U.S. PATENT DOCUMENTS 3,834,642 A * 9/1974 Kampf
4,055,313 A * 10/1977 Yamaguchi et al.
4,155,515 A * 5/1979 Schunmeier et al.
4,171,780 A 10/1979 Bugnone
4,875,632 A * 10/1989 Kataoka

FOREIGN PATENT DOCUMENTS

DE 1816870 7/1970
DE 3629216 A1 3/1988

* cited by examiner

*Primary Examiner*—William A. Rivera
(74) *Attorney, Agent, or Firm*—Oliff & Berridge, PLC

(57) ABSTRACT

A machine that has an assembly formed from a frame on which is rotatably mounted on a drum with parallel winding cores. This assembly is mounted so as to move translationally in a horizontal direction perpendicular to the axes of the drum and of the cores, while the sheet product feeding mechanism is fixed. The translational displacement of the movable assembly allows its gradual advance as the diameter of a reel being formed grows and also makes it possible to leave, between this assembly and the sheet product feeding mechanism, a gap available for an operator, for the purpose of introducing the leading edge of the sheet product onto one of the cores.

4 Claims, 2 Drawing Sheets

MACHINE FOR WINDING CONTINUOUS SHEET PRODUCT FOR FORMING COILS

Figure 1:
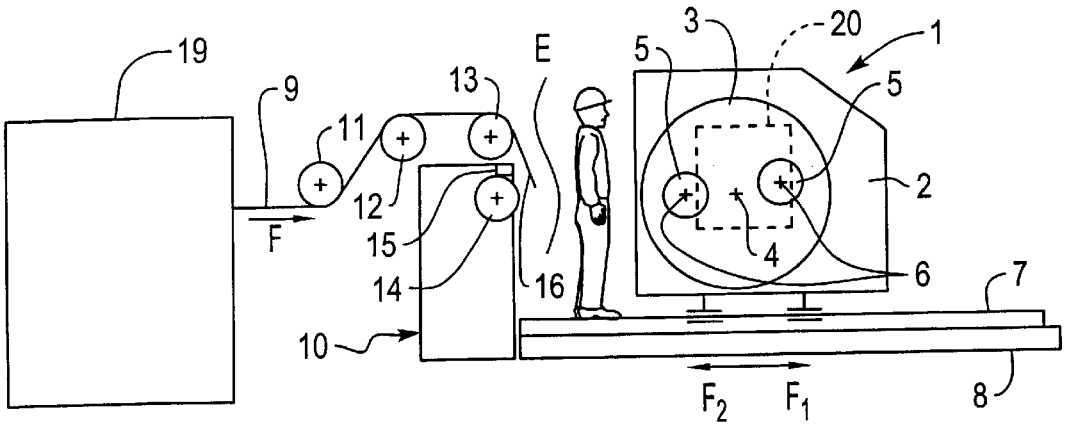
Figure 2:
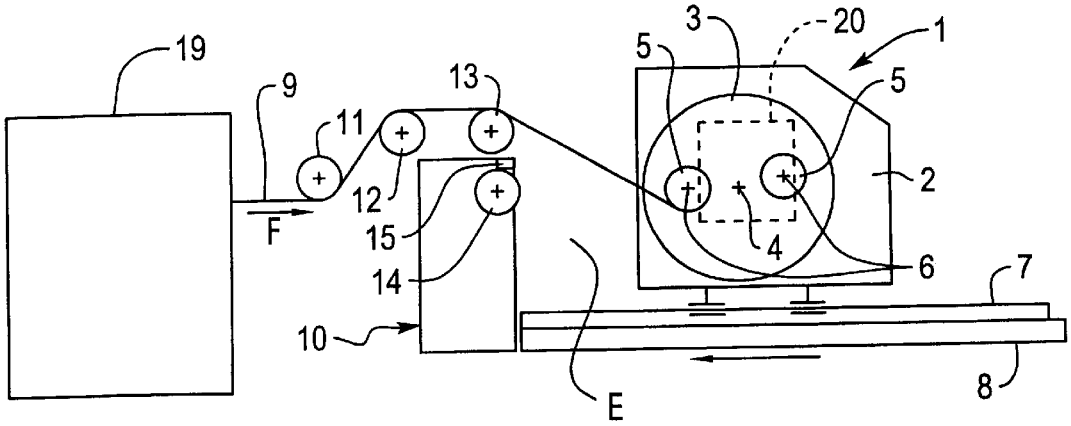
Figure 3:
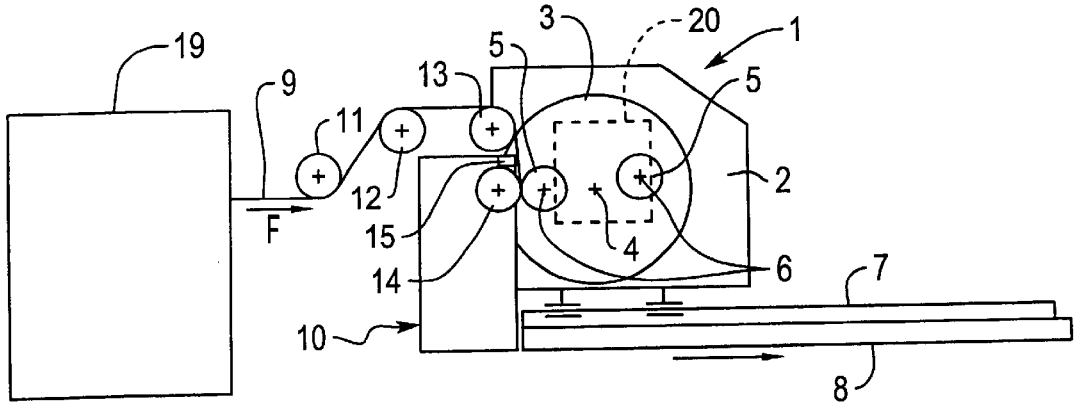
Figure 4:
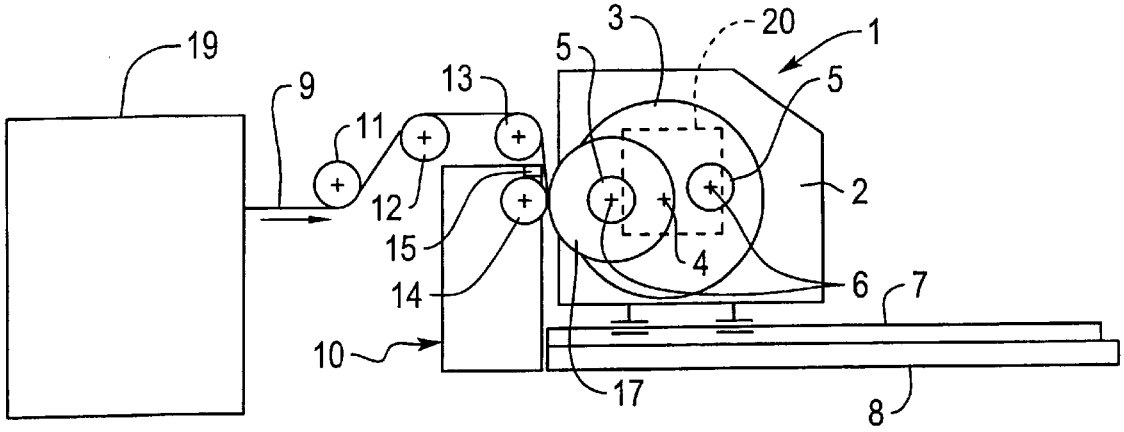

The present invention relates to a winding machine or "winder", for a continuous product in sheet form, in order to form reels.

Winders are used in many branches of industry in which the production machines and processes used result in the continuous manufacture of a flat product or relatively large width and of variable thickness. The flat elements produced by the manufacturing lines must be wound so as to be able to be easily stored and/or transported to the subsequent conversion steps.

This is the case in particular in industrial processes and machines used for the continuous manufacture of wovens, papers, webs, plastic sheets and films, nonwovens, etc. For reasons of simplicity, the term "sheet" is used hereafter to denote various types of flat products. In the plastics field, winders are systematically used at the end of lines for manufacturing plastic film from materials as diverse as polypropylene, polyester, polyvinyl chloride, polyethylene, coextruded complex sheets, etc.

Most of these industrial processes are carried out continuously, the machines virtually never being stopped except for maintenance operations, which are spaced apart by several weeks or indeed several months.

Moreover, in order for the reels to remain handlable, as well as for other reasons connected with the winder technique, it is not possible for the diameter of the reels of the wound product to be increased in an unlimited manner. It is therefore necessary for the winders used on continuous manufacturing lines to be provided with devices allowing, without interrupting the production, to switch from a full reel, when the latter has reached the intended diameter, to a new, as yet empty, reel.

The winders intended for this kind of application comprise, in a generally known manner, a machine frame on which is mounted, so as to rotate about a horizontal axis, a rotary assembly, called a drum, provided with at least two parallel winding cores, a typical embodiment comprising two diametrically opposed cores, the cores being associated with rotational drive means; in this regard, reference may be made to documents DE-A-1,816,870 and DE-A-3,629,216. Each core receives, at a given moment, the sheet product arriving continuously from the production line, the drive means delivering to the core the torque needed for the sheet product to be wound into a reel. Once the reel is full, the drum rotates through a half turn, simultaneously allowing the full reel to be removed and a new, empty core to be brought into the winding position. Of course, a cutting device is employed before the two cores are exchanged, in order to cut the sheet material.

Necessarily associated with the main part of the winder, comprising the frame and the drum bearing the cores, are means for feeding the sheet product, the function of which is to feed the winder with product to be wound, this being done in a suitable manner, while ensuring that various operating parameters are controlled. These feed means comprise several rolls and rollers over which the sheet product to be wound passes, and especially comprising:

- a first roll, called tension measurement roll, over which the sheet product arrives approximately horizontally, and
- a second roll called contact roll, which guides the sheet product to the winding point, this contact roll exerting a pressure at the point of application on the reel being wound.

Usually, these rolls as well as other rollers are supported by a carriage or trolley on which are also mounted the tension-measuring means and the other control members, as well as the cutting device. The trolley is mounted so as to move in horizontal translation in a direction perpendicular to the axes of the drum and of the cores of the winder. Since the frame of the winder is fixed, it is the trolley which gradually moves as the reel is wound, in order to ensure permanent application of the contact roll against the reel, the diameter of which is gradually increasing. As variants, as provided in the aforementioned documents DE-A-1,816,370 and DE-A-3,629,216, the winding cores may have a limited degree of mobility in order to "absorb" the increase in diameter of the reel being formed.

In current winders, produced as recalled above, the introduction of the sheet product, upon switching on the machine or after a breakage has occurred, constitutes an extremely complex operation. This is because, on account of the above explanations, the horizontally movable trolley comprises a large number of rolls, rollers and other devices, such as the cutting device, which make this trolley a complex and heavy assembly. In addition, the winder itself, with its frame, its drum and its two cores, as well as its ancillary devices, is a heavy and bulky machine. The size of the cores cannot be reduced, particularly on very wide machines, since such a reduction would result in an unacceptable bending of the cores and, if the winding diameter is large, which is generally desired, the dimensions of the frame are necessarily large. Furthermore, since the cores are mounted on a drum which rotates, it is extremely dangerous to penetrate into the winder near the cores, and the safety recommendations prevent this kind of intervention, in most factories and countries.

When the leading edge of the sheet product to be wound is presented, it is consequently extremely difficult to make the sheet pass through the winder, in order to feed it onto one of the two winding cores.

At the present time, in order to be carried out in a relatively acceptable manner, such an operation requires the intervention of at least two persons, one feeding the sheet above the trolley which has been brought beforehand into the retracted position, the sheet with a little luck dropping to the floor where it is picked up by the second person at the output end of the winder, using a hook or sometimes an automatic belt arrives behind the winder. This operation remains difficult and dangerous, particularly when the machine is operating at high speed.

The present invention aims to avoid these difficulties and the object of the invention is therefore to provide a winder of the kind in question, in which the operations of introducing the sheet may be carried out at high speed, without the safety of the persons in charge of these operations being threatened, or even with a single operator.

For this purpose, the subject of the invention is a machine for winding a continuous product in sheet form, in order to form reels, comprising a machine frame on which is mounted, so as to rotate about a horizontal axis, a drum provided with at least two parallel winding cores associated with rotational drive means, the rotation of the drum simultaneously allowing a full reel to be removed and an empty core to be brought into the winding position, the machine also including means for feeding the sheet product to be wound, these means comprising various rolls and rollers, such as a tension-measuring roll and a contact roll, as well as, preferably, control members and a cutting device, this winding machine being characterized in that the assembly comprising the frame, the drum and the winding cores is mounted so as to move in horizontal translation in a direction perpendicular to the axes of the drum and of the cores, whereas the means for feeding the sheet product are fixed, the translational displacement of the movable assembly comprising the frame, the drum and the cores allowing its gradual advance as the diameter of a reel being formed grows, and the total travel of this displacement being such that it makes it possible to leave, between this assembly and the feed means, a gap available for an operator for the purpose of introducing the leading edge of the sheet product onto one of the cores of the winding machine.

Thus, unlike the conventional design of winders, in which the feed means are carried by a trolley which can move so as to gradually retreat during the steady growth of the diameter of the reel being formed, the present invention proposes to keep the feed means in a fixed position, and thus it is the assembly consisting of the frame, the drum and the cores which is movable and which, more specifically, moves in the direction of travel of the sheet product, by moving away from the means for feeding this product, so as to "follow" the gradual enlargement of the reel being wound. The total travel of the aforementioned assembly is not limited to the distance between the minimum radius and the maximum radius of a reel, but it is provided to be sufficiently long to create, between the fixed feed means and the frame/drum/cores assembly advanced to the maximum amount, a sufficient gap of the order of 1 to 2 meters. This space becomes available so that the operator, on starting up the machine, is able, without any danger, to recover the leading edge of the sheet product on the feed means and bring this end directly onto that one of the two cores of the winder which is in its immediate vicinity.

Admittedly, document U.S. Pat. No. 4,171,780 already provides a winder in which the assembly comprising the frame, the drum and the cores is movable horizontally, but in that document, as in those mentioned previously, the mobility which results therefrom remains very limited and makes it possible only to absorb the variation in diameter of the reel being formed.

It will be noted that, apart from the phase of introducing the sheet to be wound, the operation of the winder forming the subject of the present invention is not modified in its principle. This is because the feed means, hereafter fixed, remain provided, as previously, with a tension-measuring roll and with a contact roll, which is itself fastened to a device for the fine control of the application pressure. The only difference, which in this case is fundamental, resides in the fact that the frame-drum-cores assembly, which previously had been fixed, is made movable and moves in the general direction of advance of the sheet, slowly and gradually, along suitable guides during the phase of winding the reel, in order to compensate for the steady growth of the diameter of the reel. Furthermore, this movable assembly is moved forward rapidly and with a long travel, when it is necessary to leave a place for one or more operators in order to allow them to work on the machine without any danger.

The design of the winding machine forming the subject of the invention thus has a considerable advantage, which cannot be obtained in the prior art. Admittedly, in existing machines, the trolley supporting the feed means moves back in order to adapt to the growth in the diameter of the reel, but this trolley cannot move back enough to create, between itself and the rest of the machine, the space needed for the work by the operators. This is because the rearward travel of the trolley is limited by the usual presence, upstream of this trolley, of the equipment belonging to the line for producing and for treating the sheet product. Nor is it possible to create, upstream of the trolley, a large gap in order to allow the trolley to move back with a long travel since, in this case, the sheet product would have to span a large distance without being guided or supported, something which would be highly prejudicial to the quality of the winding carried out by the machine.

The winder forming the subject of the present invention has an additional advantage, which stems from the foregoing. In winders of the conventional type, it is necessary to allow the trolley to have a rearward travel which corresponds at least to the half-diameter (or radius) of the largest reel wound so that the trolley can move back sufficiently to allow a full reel with this maximum dimension to be formed. Such a retraction of the trolley has the immediate consequence that the travel of the sheet immediately upstream of the winder, and the turn angles of the sheet penetrating the winder, are modified as the trolley moves back, this having the consequence of disturbing the measurement of the tension in the sheet and is sometimes the cause of undesirable creases and winding defects. These drawbacks are avoided with the winder forming the subject of the present invention, in which the feed means, having become fixed, may be integrated into the roll assembly located at the output end of the production machine, the winding conditions thus being made constant and able to be optimized. Thus, the winder forming the subject of the present invention provides not only considerable ease of access but also better winding conditions.

The design of the winder according to the invention furthermore includes a certain number of additional advantages:

As already indicated above, the fixed feed means may be integrated into the output end of the production machine which precedes the winder, it being possible for the support for these feed means to be easily integrated into the frame for said machine output end, which support is designed on modern machines so that the transfer of the sheet can be carried out by the operator in a simple manner without any danger. Thus, with the arrangement forming the subject of the present invention, the introduction of the sheet already takes place in a simple manner right at the output end of the feed means and, in addition, it is no longer necessary to pass through the winder since the operator is then near the first core encountered (in the direction of travel of the sheet) of the winder. In contrast, in the case of conventional machines, the introduction took place in a simple manner only right at the upstream end of the trolley, and the difficulties arose when introducing the sheet into the winder.

The invention is thus indubitably advantageous for manual introduction of the sheet, but it goes without saying that this invention is also particularly beneficial in the case of production machines whose output ends are provided with automatic introduction systems using a belt, cord or air cushion, since it is sufficient in this case to automatically advance the sheet already as far as the output end of the feed means and it is then no longer necessary to pass through the winder.

The arrangement forming the subject of the present invention is also particularly beneficial in relation to the use of a cutting device, especially a cutting device located between the tension-measuring roll and the contact roll. In this case, the simple introduction of the sheet takes place directly, right at, and including from, the cutting blade which can be used without any danger to the operators so as to make a clean transverse cut in the sheet, before putting the end of this sheet onto the winding core (the cut part of the sheet being removed either on the ground sideways or directly into a grinder located under the machine).

The winder forming the subject of the present invention is also particularly beneficial when the discharge of the full reel is carried out, which is more and more often the case, by a device called a wire-guided or remote-guided trolley, the functions of which are to return, automatically or otherwise, near to the core at the front of the winder, when the full reel has been transferred thereonto by the rotation of the drum, to remove the full reel and, optionally, to deposit, in place of this removed reel, a new empty reel support. In the case of conventional winders, in which the operator's work station is, during introduction of the sheet, at the front of the winder, that is to say in the very region in which this trolley has to work, the question obviously arises as to the priority and the safety of the operator vis-à-vis this trolley. On the one hand, the operator is prohibited from penetrating the region in which the trolley moves but, on the other hand, the presence of the operator in this same region is essential when starting up the machine. In contrast, in the case of the winder forming the subject of the present invention there is a clear separation between the operator's work station, which hereafter lies upstream of the frame of the winder, and the region in which the trolley moves and works, which lies on the opposite side (downstream).

Finally, the winding quality is also greatly improved on the machine forming the subject of the present invention, by virtue of the fixity of the contact roll forming part of the feed means. In conventional winders, the trolley must be provided with pressure devices for keeping the contact roll in place, which devices must be sensitive and almost frictionless, while these are mounted on a trolley which must at the same time move backward, consequently disturbing the proper execution of the winding operation. This problem is avoided in the winder forming the subject of the present invention in which, since the feed means are fixed, the contact roll may be provided with very flexible and frictionless pressure members, the frame-drum-cores assembly itself being moved slowly forward, in an independent manner, according to the growth in the diameter of the reel.

It should be noted that the translational displacement of this movable frame-drum-cores assembly may be accomplished by means of various mechanical or electromechanical or hydraulic, motorized actuation devices, such as hydraulic cylinders. Preferably, the actuation device here consists of an assembly comprising at least one electric stepper motor and at least one ball screw driven by the motor. Given the good efficiency of the precision in ball-screw mechanisms and the very wide speed control range of stepper motors, it is then possible to request the same motor to carry out not only the slow and steady displacement of the movable frame-drum-cores assembly, in order to "follow" the enlargement of the reel, but also the rapid displacement, and with a long travel, of this frame-drum-cores assembly in order to move it forward, clearing the space needed for access by the operator in order to introduce the sheet onto one of the cores.

The invention will, in any case be more clearly understood with the aid of the description which follows, with reference to the appended schematic drawing representing, by way of example, one embodiment of this machine for winding a continuous product in sheet form, in order to form reels.

FIGS. 1 to 5 of the drawing represent, in side view, a winder according to the present invention in several different positions corresponding to the various phases of use or of operation.

In a generally known manner, the winder comprises an assembly denoted overall by a reference 1, comprising a frame 2, a drum 3 mounted so as to rotate on the frame 2 about a horizontal axis 4, and two parallel winding cores 5, each of horizontal axis 6, which are diametrically opposed and supported by the drum 3. Motorized members 20 rotate the drum 3 about its axis 4 and rotate each core 5 about its axis 6.

The assembly 1 formed by the frame 2, the drum 3 and the two cores 5 is mounted so as to move translationally along horizontal rectilinear guides 7 supported by a fixed base 8 of the machine. Means 20, such as an electric stepper motor associated with a ball screw, ensure translational displacement of the assembly 1 along the guide 7, either toward the front (arrow F1) or toward the rear (arrow F2), the terms "front" and "rear" being defined here with reference to the general direction of travel (arrow F) of the sheet produce 9 to be wound.

Provided at the rear of the base 8 is a fixed assembly 10 serving for feeding the sheet product 9 coming from a manufacturing machine 19 located upstream. The assembly 10 comprises a succession of rolls or rollers 11, 12, 12 and 14 over which the sheet product 9 is guided. Provided particularly on the front side of the assembly 10 is a tension-measuring roll 13 which lies above a contact roll 14. Also provided, between these latter two rolls 13 and 14, is a cutting device 15 which has cutting members that can move transversely to the direction of advance of the sheet product 9.

By virtue of the configuration described above, the movable assembly 1 formed by the frame 2, the drum 3 and the two cores 5 can be moved in a controlled manner, over a relatively long travel, between a rear position very close to the fixed assembly 10 serving for feeding the sheet product 9, and a forward position relatively far from said fixed assembly 10, it being possible, of course, for all intermediate positions to be occupied.

More particularly, in the forward position (FIG. 1), a relatively large gap E, of about 1 to 2 meters, is provided above the base 8, between the movable assembly 1 and the fixed assembly 10. As shown, an operator can thus stand in this gap E in order, during startup of the machine, to grip the leading edge 16 of the sheet product 9 and introduce it onto one of the cores 5, more particularly the core located in the winding position, that is to say that furthest to the rear.

Once the sheet product 9 has been engaged on the core 5 in question (see FIG. 2), the process of winding this product 9 can start. For this purpose, the movable assembly 1 is firstly moved back, until the core 5 in question bears on the contact roller 14, which is located at its height (see FIG. 3). Next, the core 5 is rotated so as to cause the sheet product 9 to be wound around this core 5, in order to form a reel 17 (see FIG. 4). As the winding progresses, the diameter of the reel 17 gradually increases, this being compensated for by a corresponding slow advance of the movable assembly 1.

Figure 5:
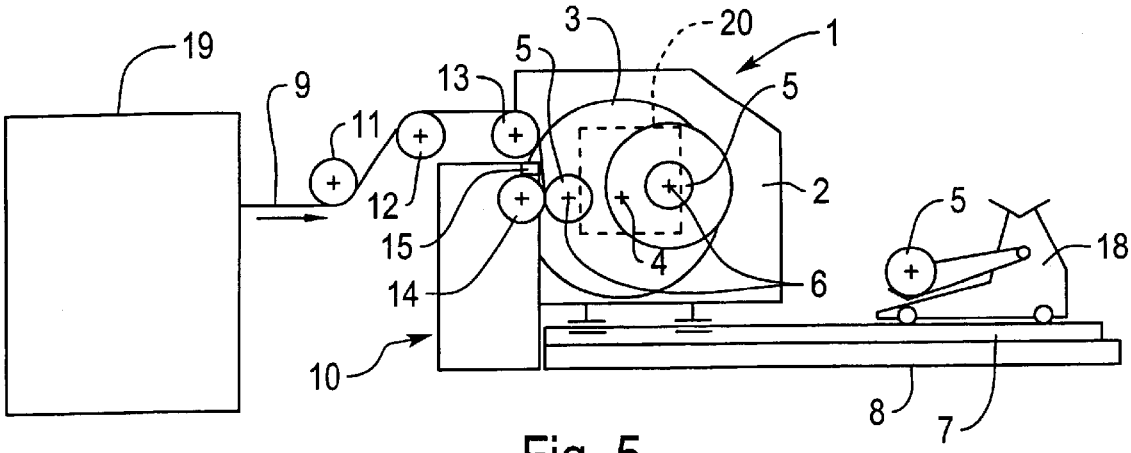

When the reel 17 has been completely formed, the cutting device 15 is used to separate the length of sheet product wound and the drum 3 describes a rotation of a half turn about its axis 4 (see FIG. 5). At this moment, an auxiliary trolley 18, which can move along the base 8, may be brought up to the movable assembly 1, via the front of the latter, in order to remove the full reel 17 and possibly deposit on the drum 3, in its stead, a new, empty reel support.

The movable assembly 1, having also been moved back, bringing the core that has come into the winding position, during the last rotation of the drum 3, against the bearing roll 14, the machine is ready to execute a new cycle, identical to the previous one.

It would not be a departure from the spirit of the invention to modify the means for moving the movable frame-drum-cores assembly, or to modify the number and arrangement of the rolls and/or rollers of the fixed assembly for feeding the sheet product, it being possible for this product to be of any material and have any texture. By the same token, although the fixed assembly 10 for feeding the sheet product has been shown with a specific, independent frame, it will be noted that this assembly may be integrated into the output end of the machine for producing this sheet product, which machine precedes the winder.

What is claimed is:

1. Machine for winding a continuous product in sheet form, in order to form reels, comprising:

a machine frame (2) on which is mounted, so as to rotate about a horizontal axis (4), a drum (3) provided with at least two parallel winding cores (5) and an associated rotational drive means, the rotation of the drum (3) simultaneously allowing a full reel (17) to be removed and an empty core (5) to be brought into the winding position;

means (10) for feeding the sheet product (9) to be wound, these means comprising various rolls and rollers (11 to 14), and control members and a cutting device (15); and the assembly (1) comprising the frame (2), the drum (3) and the cores (5) being mounted so as to move in horizontal translation in a direction perpendicular to the axes (4, 6) of the drum (3) and of the cores (5), whereas the means (10) for feeding the sheet product (9) are fixed, the translational displacement (F1, F2) of the movable assembly (1) comprising the frame (2), the drum (3) and the cores (5) allowing its gradual advance as the diameter of the reel (17) being formed grows;

wherein the total displacement travel of the movable assembly (1) comprising the frame (2), the drum (3) and the cores (5) is not limited to the difference between the minimum radius and the maximum radius of a reel (17) and is provided so as to be sufficiently long to leave, between this assembly (1) and the feed means (10), a gap (E) available for an operator for the purpose of introducing the leading edge (16) of the sheet product onto one of the cores (5) of the winding machine.

2. Winding machine according to claim 1, characterized in that the gap (E) created by the movable assembly (1) in the advance position is about 1 to 2 meters.

3. Winding machine according to claim 1, characterized in that the translational displacement of the movable assembly (1), comprising the frame (2), the drum (3) and the cores (5), is accomplished by means of an actuation device comprising at least one electric stepper motor and at least one ball screw driven by the motor.

4. Winding machine according to claim 1, characterized in that the fixed means (10) for feeding the sheet product (9) are integrated into the output end of a machine for producing this sheet product (9), which machine precedes the winder.

* * * * *